US009597722B2

(12) United States Patent
Faulstich et al.

(10) Patent No.: US 9,597,722 B2
(45) Date of Patent: Mar. 21, 2017

(54) PRESSING TOOL AND METHOD FOR MANUFACTURING A PRESSING TOOL

(71) Applicant: Rothenberger AG, Kelkheim (DE)

(72) Inventors: Markus Faulstich, Raunheim (DE); Thoralf Krause, Leipzig (DE); Arnd Greding, Hofheim (DE)

(73) Assignee: ROTHENBERGER AG, Kelkheim (DE)

( * ) Notice: Subject to any disclaimer, the term of this patent is extended or adjusted under 35 U.S.C. 154(b) by 189 days.

(21) Appl. No.: 14/446,401

(22) Filed: Jul. 30, 2014

(65) Prior Publication Data

US 2015/0033524 A1 Feb. 5, 2015

(30) Foreign Application Priority Data

Jul. 30, 2013 (DE) ..... 10 2013 108 162

(51) Int. Cl.

| | |
|---|---|
| ***B25B 27/10*** | (2006.01) |
| ***B21D 39/04*** | (2006.01) |
| ***C21D 1/09*** | (2006.01) |
| ***C21D 9/00*** | (2006.01) |

(52) U.S. Cl.

CPC ..... *B21D 39/048* (2013.01); *B25B 27/10* (2013.01); *C21D 1/09* (2013.01); *C21D 9/0068* (2013.01); *Y10T 29/53726* (2015.01)

(58) Field of Classification Search

CPC ..... B21D 39/048; C21D 1/09; C21D 9/0068; C21D 9/18; C21D 10/005; C21D 2221/00; C21D 2221/01; C21D 2221/02; B23K 26/0029; B25B 27/10

See application file for complete search history.

(56) References Cited

U.S. PATENT DOCUMENTS

| | | | | | |
|---|---|---|---|---|---|
| 1,364,582 | A * | 1/1921 | Reed | E21B 19/161 | 81/90.2 |
| 4,533,400 | A * | 8/1985 | Benedict | B23K 26/067 | 148/565 |
| 4,872,429 | A * | 10/1989 | Anderson | B21D 53/88 | 123/90.44 |
| 5,671,628 | A * | 9/1997 | Halila | C21D 10/005 | 148/525 |
| 6,002,102 | A * | 12/1999 | Dulaney | B23K 26/0069 | 148/525 |

(Continued)

FOREIGN PATENT DOCUMENTS

| | | | |
|---|---|---|---|
| DE | 102006050799 | A1 | 5/2008 |
| EP | 1447179 | A2 | 8/2004 |
| WO | WO 2005049280 | A1 | 6/2005 |

OTHER PUBLICATIONS

B Mordike: "Lasers and the Processing of Engineering Materials", Journal de Physique Colloques, Dec. 1987, XP055170407, URL: https://hai.archives-ouvertes.fr/ipa-00226910/documents, found on Feb. 18, 2015, pp. C7-C37-pp. C7-C38, figure 1.

*Primary Examiner* — Edward Tolan

(74) *Attorney, Agent, or Firm* — Leydig, Voit & Mayer, Ltd.

(57) ABSTRACT

A method for manufacturing a pressing tool includes shaping a blank, which is able to be hardened, at least in part, to a final size of a pressing jaw. Then, a laser beam is applied to at least one selected region of a surface of the pressing jaw so as to form at least one hardened surface layer.

16 Claims, 4 Drawing Sheets

(56) References Cited

U.S. PATENT DOCUMENTS

| | | | | |
|---|---|---|---|---|
| 8,858,733 | B2 * | 10/2014 | Pillai | B23K 26/0066 148/565 |
| 2003/0046973 | A1 | 3/2003 | Hamm et al. | |
| 2003/0066390 | A1 * | 4/2003 | Mack | B23B 31/1215 76/101.1 |
| 2007/0251070 | A1 | 11/2007 | Amherd | |
| 2009/0205754 | A1 * | 8/2009 | Kanemitsu | C21D 1/09 148/500 |
| 2010/0126642 | A1 | 5/2010 | Brenner et al. | |
| 2012/0055030 | A1 * | 3/2012 | Latronico | B25B 7/12 30/186 |
| 2015/0082764 | A1 * | 3/2015 | Johnson | A01D 34/18 56/298 |

* cited by examiner

PRESSING TOOL AND METHOD FOR MANUFACTURING A PRESSING TOOL

CROSS-REFERENCE TO PRIOR APPLICATION

Priority is claimed to German Patent Application No. DE 10 2013 108 162.2, filed on Jul. 30, 2013, the entire disclosure of which is hereby incorporated by reference herein.

FIELD

The invention relates to a method for manufacturing a pressing tool. The invention further relates to a pressing tool which can be produced by a method of this type.

BACKGROUND

Pressing tools of this type are conventionally used for connecting lengths of pipe, by crimping the lengths of pipe together using the pressing tool. For this purpose, the pressing tools comprise at least two pressing jaws, which can be moved towards one another and between which the lengths of pipe to be connected can be brought. As a result of moving the pressing tools towards one another, a deforming force is exerted on the lengths of pipe to be connected, and as a result the crimping together of the lengths of pipe is completed.

For reasons of wear protection, the pressing jaws are conventionally surface-hardened in various regions. Thus far, nitrocarburising for example has been used as a hardening method. Because this method can only achieve a small hardening depth, drawbacks as regards service life have had to be accepted thus far.

SUMMARY

In an embodiment, the present invention provides a method for manufacturing a pressing tool. A blank, which is able to be hardened, at least in part, is shaped to a final size of a pressing jaw. Then, a laser beam is applied to at least one selected region of a surface of the pressing jaw so as to form at least one hardened surface layer.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
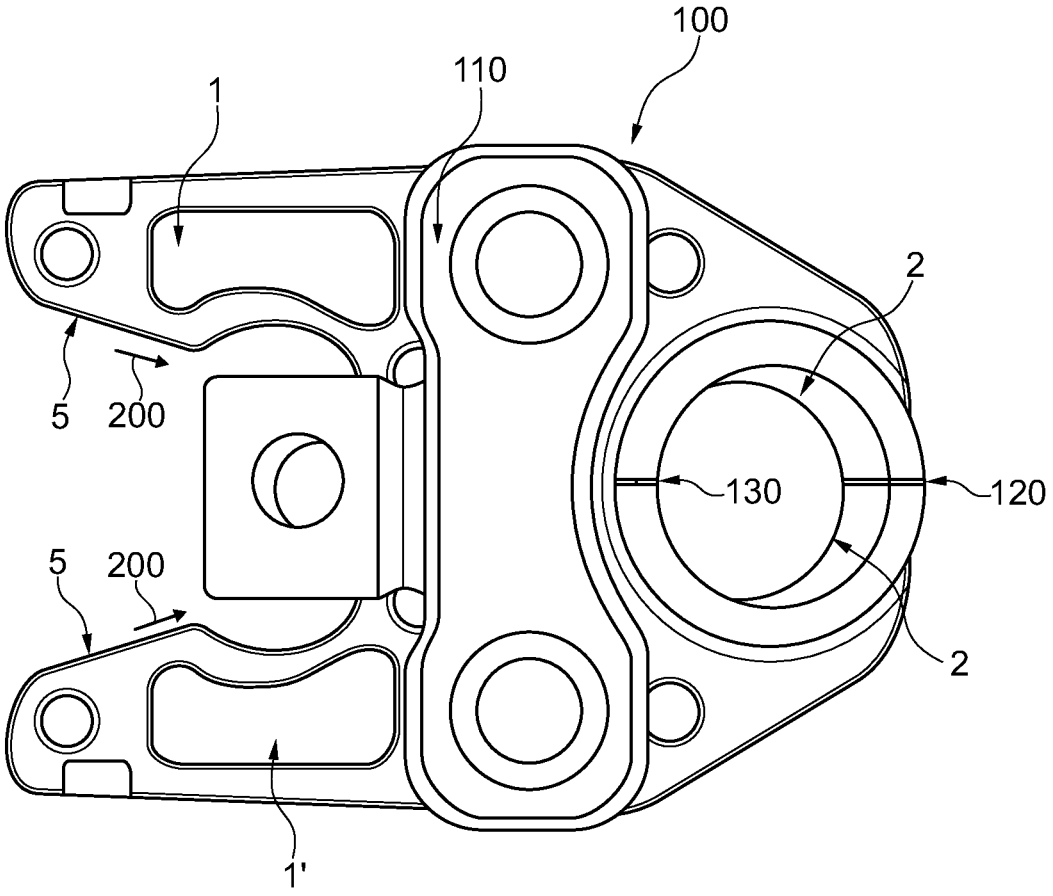
FIG. 1 is a perspective drawing of a possible embodiment of a pressing tool for connecting workpieces by deformation.

In an embodiment, the present invention provides possibilities for counteracting premature appearances of wear on the pressing tool, in particular on the pressing jaws thereof, and thus extending the service life.

A method according to an embodiment of the invention for manufacturing a pressing tool comprises the following steps, carried out successively in the order listed:

i) shaping a blank, which can be hardened, at least in part, to the final size or a final dimension of a pressing jaw, and ii) applying a laser beam to at least a selected region of the surface of the pressing jaw, to form at least one hardened surface layer.

By manufacturing a pressing tool in this way, hardened surface layers can be produced on the pressing jaws, the hardness and hardening depth of said layers being large enough to achieve a long service life. Using a beam, namely the laser beam, means that selected local surface regions of the pressing tool can additionally be hardened, without also having to heat the entire pressing tool or the respective pressing jaw. As a result, a sharp delimitation between hardened regions and unhardened regions on the pressing tool or the respective pressing jaw can be achieved, in such a way that it is also possible, with high dimensional accuracy, for only the regions intended for hardening actually to be hardened. This high dimensional accuracy of the hardening is achieved because the action of the laser beam merely causes a small region of a surface layer to be heated, and the necessary very rapid cooling is brought about by the dissipation of the heat into the pressing tool or pressing jaw. Thus, neither the pressing tool nor the pressing jaw needs to be heated or to be cooled by a quenching medium, so as to form the hardened layer. The hardened layer is therefore formed by a relatively simple method, and thus relatively cost-effectively.

The blank used for manufacturing the pressing jaw may be forged or be manufactured by casting, in particular by fine casting.

In the configuration of claim 2, materials of a crystalline structure are used. Materials of this type can be hardened, or are favourable at least for surface hardening. Because a tempered steel is used, in particular a highly tempered steel, the hardened surface layer can be formed in the at least one selected region whilst the remainder of the pressing jaw still retains its ductile structure. This prevents brittle fracturing and associated cracking of the pressing jaw from occurring in the event of overloading. The ductile structure of the pressing jaw in the unhardened regions thus ensures sufficient deformation of the material, in the event of overload, for at most ductile fracturing to occur.

In the configuration of claim 3, sufficient thickness of the hardening layer is ensured to achieve sufficient wear resistance and thus a long service life.

In particular, the thickness of the hardened layer also constitutes the hardening depth over which the hardened layer extends from the surface of the pressing jaw.

So as to achieve constant hardness over the selected region, the thickness of the hardened layer should be substantially constant, in particular uniformly constant.

Alternatively, it may be provided that the thickness of the hardened layer varies or can vary between approximately 0.2 mm and approximately 1.5 mm, in particular between 0.5 mm and 1.2 mm.

In the configuration of claim 4, the at least one region subjected to a particularly high load when the lengths of pipe are crimped is affected by the hardening treatment. During the closing movement of the pressing jaws, the relevant transition from the die to the end face rubs along the outer circumference of the length of pipe to be crimped, and thus experiences a high mechanical load. Forming the hardened layer in the transition prevents premature wear from occurring at the transition.

In the configuration of claim 5, the edge itself remains unhardened or at least largely unhardened, in such a way that the edge still has some capacity to absorb pressure. For example, the edge may still have a ductile structure, whilst the hardened layer in this case is formed in the adjacent transition. The edge may be an outer edge, for example a longitudinal edge.

Alternatively, the at least one selected region may even extend into the edge or beyond the edge. As a result, the hardened layer includes the edge, and so premature edge wear is counteracted.

The edge is understood to be a linear extension or the region of a linear extension or the region of a linear extension in which two faces or sides of the pressing jaws border or meet one another at an angle. The edge is thus formed by the line of intersection of two faces or sides, at an angle to one another, of the pressing jaws or by the region of the line of intersection. In particular, the edge forms a shared border of the two faces or sides, at an angle to one another, of the pressing jaws. For protection against injuries, the edge is preferably made rounded or bevelled.

In the configuration of claim 6, machining time is reduced by not lasing the entire transition from the die to the end face. As a result of only lasing the portion or portions closest to the central axis of the die, the hardened layer formed in the transition is interrupted at least once or repeatedly. As a result, potential tear formation, occurring for example over the hardened portion or portions, is effectively counteracted.

As a result of only the portion or portions closest to the central axis of the die being lased, the regions in the transition from the die to the end face, which experience a particularly high mechanical load during crimping, are still included in the hardened layer.

The central axis is understood to be the axis which is coincident with, or parallel to but at a distance from, the longitudinal axis of the lengths of pipe to be crimped, and which is positioned in the centre of the die formed by the pressing jaws.

In the configuration of claim 7, the at least one region for the hardening treatment is involved, which experiences a particularly high load when lengths of pipe are crimped. An actuation device acts on this region, namely the contact face or contact surface, thereby pressing the pressing jaws against the lengths of pipe to be crimped, so as to exert a pressing force. For this purpose, the contact face or contact surface is loaded for example by a drive roller of the actuation device. The contact face or contact surface thus experiences a high mechanical load. Forming the hardened layer prevents premature wear from occurring.

The selected region may extend on the contact surface into or beyond a rounded ramp for the running or sliding element. As a result, the rounded ramp is also included in the hardened layer brought about by the laser beam.

Alternatively, it may also be provided that the selected region extends on the contact surface and ends before or at a rounded ramp for the running or sliding element. This saves machining time, since the rounded ramp itself is excluded from the hardening.

In the configuration of the first alternative according to claim 8 and/or the configuration of the second alternative according to claim 8, the edge itself remains unhardened or at least largely unhardened, in such a way that the edge still has some capacity to absorb pressure. For example, the edge may still have a ductile structure, whilst the hardened layer is in this case formed in the adjacent region of the contact surface. The edge may be an outer edge, for example a longitudinal edge.

Alternatively, the at least one selected region may also extend into or beyond the edge. As a result, the edge is included in the hardened layer, in such a way that premature edge wear is counteracted.

In the configuration of claim 9, machining time is saved, since not the whole contact surface is lased. Since merely the strip or strips are lased, the hardened layer formed is interrupted at least once or repeatedly. As a result, potential tear formation, for example via the hardened strip or strips, is also effectively counteracted.

Since the strip or strips extend with a varying width over the longitudinal extension thereof, the contact surface can be adjusted selectively as regards the spread of the hardened layer. For example, by way of longitudinal portions of the contact surface having a particularly high pressure load by means of the running or sliding element, the strip or strips are each to be configured with an increasing width, in particular a width increasing substantially linearly, in such a way that the resulting hardened layer accordingly increases in width. As a result of this increase in the width of the hardened layer, any wobbling of the running or sliding element engaging thereon is particularly effectively counteracted, and a high positional stability for the running or sliding element is thus achieved in a simple manner.

In the configuration of claim 10, the hardened layer is further prevented from breaking away at the edge. The edge may be an edge of the above-disclosed type.

The configuration of claim 11 and similarly the configuration of claim 12 each target the advantages of the configurations of claims 9 and/or 10, the configuration of claim 11 and the configuration of claim 12 each being a particularly expedient form of the hardened layer.

In the configuration of claim 12, the lased strips are at a greater distance from one another at one end than at the other end. In this region, this greater distance between the ends particularly counteracts any wobbling of the running or sliding element engaging thereon, and thus causes a higher positional stability for the running or sliding element to be achieved.

The strips should each extend away from one another in the longitudinal extensions thereof, in the direction of the running or sliding movement carried out by the running or sliding element during the pressing process. As a result, the positional stability brought about by the strips for the sliding or running element increases with increasing loading of the contact surface by the running or sliding element. For example, in this case the strips may extend in an upright V in the direction of the running or sliding movement carried out by the running or sliding element during the pressing process.

The strips may be formed with substantially equal widths in relation to one another. The strips may also be positioned axially symmetrically to one another about the longitudinal central axis of the pressing jaw.

It is also conceivable for the strips to become wider in the direction of the running or sliding movement carried out by the running or sliding element during the pressing process, preferably in the same shape and/or increasing in width in the same way as one another. As a result, the surface pressure on the contact surface, which increases as the stroke of the running or sliding element increases, is taken into account, so as to achieve effective wear protection by way of the hardened layer.

In an embodiment, the regions of a pressing jaw, which are particularly relevant to wear, are taken into account and are lased so as to form the desired hardened surface layer.

An embodiment of the invention further comprises a method for manufacturing a pressing tool, said method having steps for:

i) manufacturing two pressing jaws by twice carrying out a method of the above-disclosed type, and ii) connecting the pressing jaws via an intermediate member, to form a pressing tool.

A further embodiment of the invention further comprises a pressing tool which is or can be manufactured by a method of the above-disclosed type.

FIG. 1 is a schematic drawing of a possible embodiment of a pressing tool 100 which is used for connecting workpieces by deformation. The pressing tool 100 comprises two pressing jaws 1 and 1', which are mounted pivotably on an intermediate member 110 in such a way that the pressing jaws 1 and 1' act in the manner of tongs.

Preferably, the pressing jaws 1 and 1' are formed with substantially the same construction. The longitudinal extensions of the pressing jaws 1 and 1' extend beyond the intermediate member 110 on both sides, the pressing jaws 1' each having a contact face 5 on one projecting side and each having a die 2 on the other projecting side.

The die 2 forms an action surface, via which the pressing jaws 1 and 1' press against a length of pipe, which is received between them and is to be crimped, for example of a pipe connection. The respective die 2 is for example in the form of a half-cylinder, sealing joints 120 and 130 being formed by the mutually opposing end faces of the respective dies 2 when the die is in the closed state as shown in FIG. 1.

The contact face 5 of the pressing jaws 1 and 1' is formed with the aim that a running or sliding element such as a drive roller can be brought into operative contact therewith. The running or sliding element may be part of a drive device for actuating the pressing tool 100. When the pressing tool 100 is actuated, the pressing jaws 1 and 1' are moved towards one another in the region of the die 2 thereof. For this purpose, the respective contact face 5 may be formed with a corresponding slant, in such a way that the running or sliding element can move in the direction of arrow 200 on the contact face 5, to actuate the pressing jaws 1 and 1'.

Figure 2:
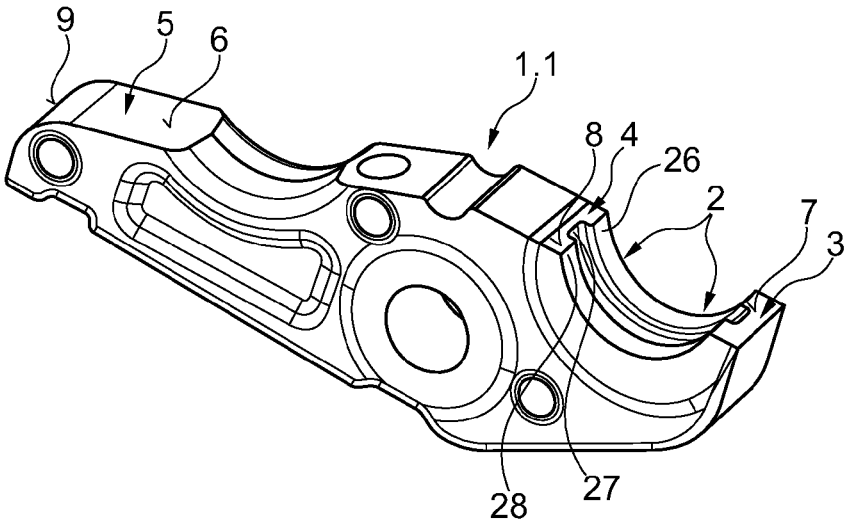
FIG. 2 is a perspective drawing of a possible embodiment of a pressing jaw for a pressing tool according to FIG. 1.

FIG. 2 shows by way of example a pressing jaw 1.1, which may be used for example in the pressing tool 100 of FIG. 1. The pressing jaw 1.1 of FIG. 2 differs from the pressing jaws 1 and 1' of FIG. 1 for example in that the die 2 forms a polygonal half-cylinder. However, the die 2 may also be of any other shape.

The die 2 of the pressing jaw 1.1 further comprises for example at least two peripheral portions, in particular three peripheral portions 26, 27 and 28, of which the peripheral portions 26 and 28 have a different diameter from the peripheral portion 27, the diameters of the peripheral portions 26 and 28 being substantially equal to one another.

The end surfaces 7 and 8 of end faces 3 and 4 are adjacent to the die 2 on both sides, and serve to form the sealing joint 120 or 130.

Figure 3:
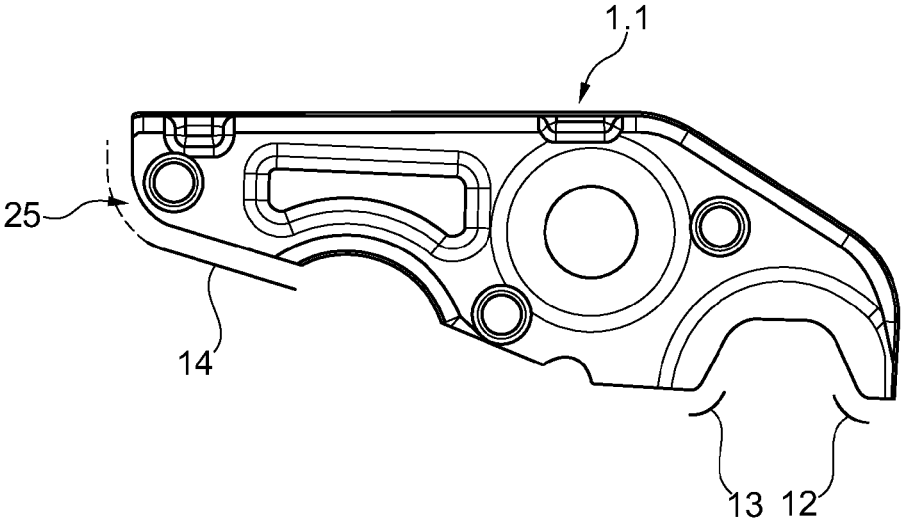
FIG. 3 is a side view of the pressing jaw of FIG. 2.

FIG. 3 shows the regions of a pressing jaw, which are particularly stressed during crimping, as they are used in the pressing tool 100, for example by way of the pressing jaw 1.1 of FIG. 2. In FIG. 3, the particularly stressed regions are marked for this purpose by the lines 12, 13 and 14 shown at a distance from the pressing jaw 1.1.

It is provided that a laser beam acts on at least one or two of these portions 12, 13 and 14 so as to form a hardened surface layer. It may also be provided that the portions 12, 13 and 14 are all lased.

FIGS. 4 to 10 show examples of lasing the portions 12, 13 and/or 14.

Figure 4:
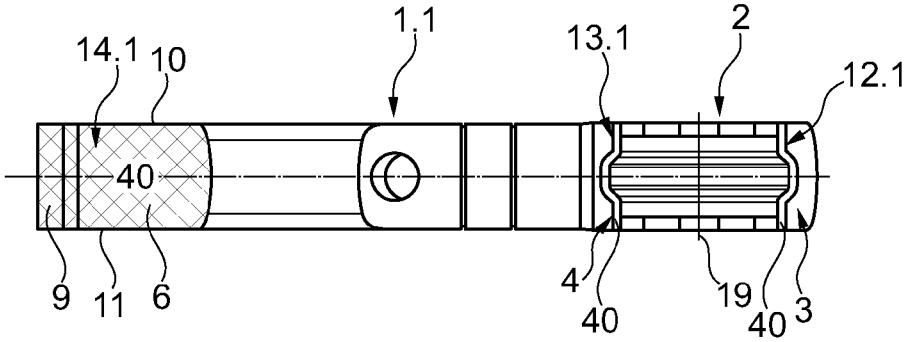
FIG. 4 shows the pressing jaw of FIG. 2 from below, regions of a die and of a contact surface having been lased in a first pattern.

FIG. 4 shows the pressing jaw 1.1 from below. In this drawing, a laser beam has been applied to the pressing jaw 1.1 in a plurality of selected regions 12.1, 13.1 and 14.1, in such a way that a hardened surface layer 40 has formed in each of the selected regions 12.1, 13.1 and 14.1. The selection region 12.1 is located in the transition from the die 2 to the end face 3 which serves to form the sealing joint 120. The selected region 13.1 is located in the transition from the die 2 to the end face 4 which serves to form the sealing joint 130. The end faces 3 and 4 are each adjacent to the die 2 at an end face, in relation to the outer periphery.

The transition from the die 2 to the end face 3 and the transition from the die 2 to the end face 4 are preferably arranged at substantially the same distance from the central axis 19 of the die 2. In the transition from the die 2 to the end face 3 and in the transition from the die 2 to the end face 4, the selected region 12.1 and the selected region 13.1 respectively extend into the opposing edges 10 and 11 which preferably form outer edges.

A further selected region 14.1, which has been lased, relates to the contact surface 6 of the contact face 5. As a result of the lasing, the hardened layer 40 is also formed therein. The selected region 14.1 likewise extends therein into the opposing edges 10 and 11. For example, the selected region 14.1 extends beyond the arc portion 9 of the rounded ramp 25.

Figure 5:
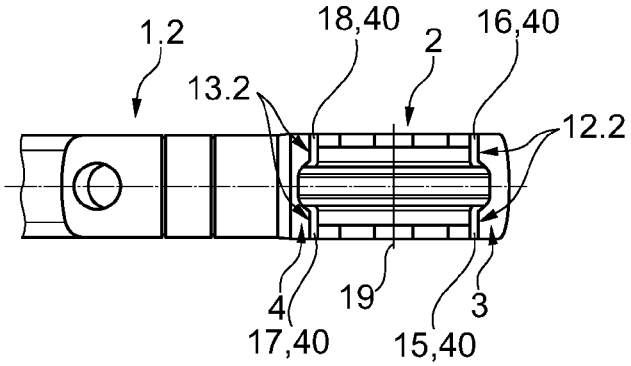
FIG. 5 is a detail of the pressing jaw of FIG. 2 in the region of the die thereof, selected regions therein having been lased in a further pattern.

FIG. 5 is a detail of a further embodiment of a pressing jaw 1.2 in the region of the die 2.

Components of the pressing jaw 1.2 of FIG. 5, which are identical to those of the pressing jaw 1.1 of FIGS. 2 to 4, are provided with the same reference numerals; in this regard, reference is made to the description of the pressing jaw 1.1.

Inter alia, the pressing jaw 1.2 of FIG. 5 differs from the pressing jaw 1.1 of FIG. 4 in that only portions 15, 16 and 17, 18 at the smallest distance from the central axis 19 of the die 2 have been lased in each case in the transition from the die 2 to the end face 3 and likewise in the transition from the die 2 to the end face 4, and so the hardened layer 40 has also only been formed therein.

Figure 6:
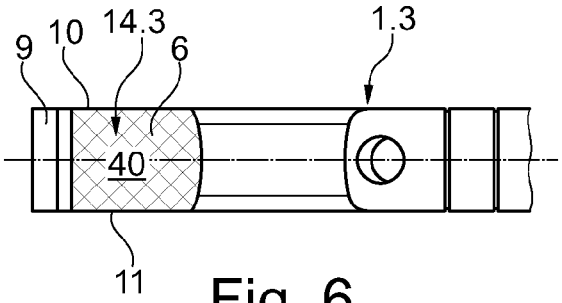
FIGS. 6, 7, 8, 9 and 10 are each a detail of the pressing jaw of FIG. 2 in the region of the contact surface thereof, selected regions of the contact surface having been lased in different patterns.

FIG. 6 is a detail of a pressing jaw 1.3 in the region of the contact surface 6 thereof. Inter alia, the pressing jaw 1.3 of FIG. 6 differs from the pressing jaw 1.1 of FIG. 4 in that a selected region 14.3 has been lased, which merely extends as far as or short of the arc portion 9 of the rounded ramp 25. Thus, the arc portion 9 may for example still have a ductile structure, whilst the hardened layer 40 has formed on the remaining contact surface 6.

Figure 7:
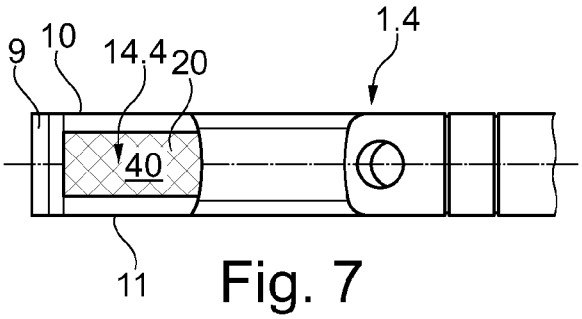

FIG. 7 is a detail of a further pressing jaw 1.4 in the region of the contact surface 6 thereof. Inter alia, the pressing jaw 1.4 of FIG. 7 differs from the pressing jaw 1.3 of FIG. 6 in that a selected region 14.4 has been lased, which is positioned on the contact surface 6, but already ends at a distance from the opposing longitudinal edges 10 and 11. The selected region 14.4 may for example be positioned on the contact surface 6 in the manner of a single strip 20, for example in that the strip 20 has been created by continuously feeding the laser beam.

The single strip 20 preferably extends in the direction of the running or sliding movement of a running or sliding element.

Figure 8:
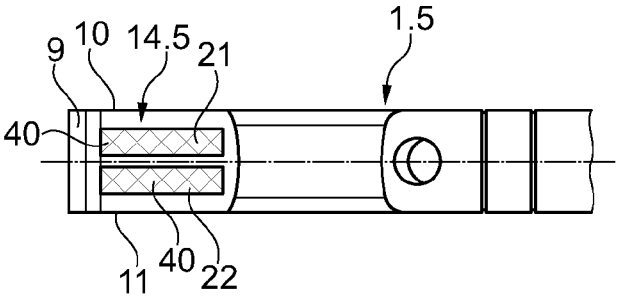

FIG. 8 is a detail of a further pressing jaw 1.5 in the region of the contact surface 6 thereof. Inter alia, the pressing jaw 1.5 of FIG. 8 differs from the pressing jaw 1.4 of FIG. 7 in that, on the contact surface 6, a selected region 14.5 has been lased, which extends in two strips 21 and 22. It is provided that the strips 21 and 22 are spaced apart, in particular positioned at substantially the same distance from one another, and extend, in the longitudinal extensions thereof, in the direction of the running or sliding movement of the running or sliding element.

Preferably, at least one of the strips 21 and 22 has a constant width in the direction of the longitudinal extension thereof. The strips 21 and 22 may also each have a constant width in the direction of the longitudinal extensions thereof. It is also conceivable for the strips 21 and 22 to be formed with substantially the same width as one another.

Figure 9:
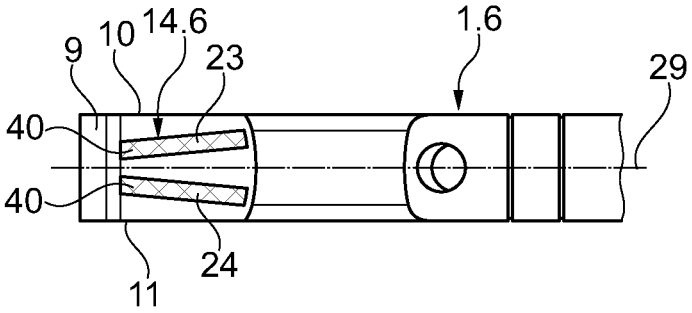

FIG. 9 is a detail of yet another pressing jaw 1.6 in the region of the contact surface 6 thereof. Inter alia, the pressing jaw 1.6 of FIG. 9 differs from the pressing jaw 1.5 of FIG. 8 in that in this case there is a selected region 14.6 formed by two strips 23 and 24 on the contact surface 6, the strips 23 and 24 extending away from one another, preferably forming a V shape.

Preferably, the strips 23 and 24 extend away from one another along the arrow 200, in the direction of the running or sliding movement carried out by the running or sliding element during the pressing process.

The longitudinal extension of the strips 23 and 24 may extend as far as or into the rounded ramp 25, in particular as far as, into or beyond the arc portion 9 thereof.

The strips 23 and 24 each have a constant width in the direction of the longitudinal extensions thereof. Preferably, the strips 23 and 24 are formed with substantially the same width. The strips 23 and 24 may also be formed axially symmetrically with respect to one another about the longitudinal central axis 29 of the pressing jaw 1.6.

Figure 10:
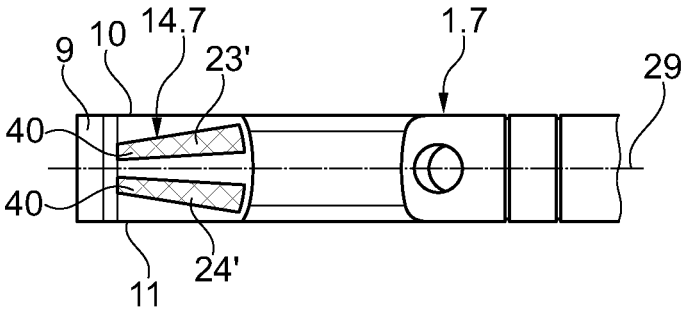

In a departure from the pressing jaw 1.6 of FIG. 9, FIG. 10 shows a pressing jaw 1.7 having a lased selected region 14.7 formed by two strips 23' and 24' on the contact surface 6, the strips 23' and 24' each having a varying width in the direction of the longitudinal extension thereof.

Preferably, the strips 23' and 24' extend away from one another along the arrow 200, in the direction of the running or sliding movement carried out by the running or sliding element, the strips 23' and 24' simultaneously increasing in width in this direction, preferably in the same shape and/or increasing in width in the same way as one another.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1, 1' Pressing jaw
1.1 Pressing jaw
1.2 Pressing jaw
1.3 Pressing jaw
1.4 Pressing jaw
1.5 Pressing jaw
1.6 Pressing jaw
1.7 Pressing jaw
2 Die
3 End face
4 End face
5 Contact face
6 Contact surface
7 End face
8 End face
9 Arc portion
10 Edge
11 Edge
12 Portion
12.1 Selected region
12.2 Selected region
12 Portion
13.1 Selected region
13.2 Selected region
14 Portion
14.1 Selected region
14.3 Selected region
14.4 Selected region
14.5 Selected region
14.6 Selected region
14.7 Selected region
15 Portion
16 Portion
17 Portion
18 Portion
19 Central axis
20 Strip
21 Strip
22 Strip
23 Strip
23' Strip
24 Strip
24' Strip
25 Rounded ramp
26 Peripheral portion

27 Peripheral portion
28 Peripheral portion
29 Longitudinal central axis
40 Hardened layer
100 Pressing tool
110 Intermediate member
120 Sealing joint
130 Sealing joint
200 Arrow

What is claimed is:

1. A method for manufacturing a pressing tool, comprising:

i) shaping a blank, which is able to be hardened, at least in part, to a final size of a pressing jaw, the pressing haw having a die and at least one end face configured to form a sealing joint; and ii) applying a laser beam to at least one selected region of a surface of the pressing jaw so as to form at least one laser hardened surface layer, the at least one selected region being positioned in a transition region from the die to the at least one end face, wherein the at least one selected region is additionally positioned at a distance from at least one edge in the transition from the die to the end face such that the at least one edge itself remains unhardened or at least largely unhardened.

2. The method according to claim 1, wherein the pressing jaw comprises or consists of a metal alloy.

3. The method according to claim 2, wherein the metal alloy is highly tempered steel.

4. The method according to claim 1, wherein the at least one hardened surface layer has a thickness of approximately 0.2 to approximately 1.5 mm.

5. The method according to claim 4, wherein the thickness is 0.5 mm to 1.2 mm.

6. The method according to claim 1, wherein only a portion or portions at a smallest distance from a central axis of the die is/are lased in the transition from the die to the end face.

7. A method for manufacturing a pressing tool, comprising:

i) manufacturing two pressing jaws by twice carrying out the method according to claim 1, and ii) connecting the pressing jaws via an intermediate member to form the pressing tool.

8. A pressing tool made by the method according to claim 1.

9. A method for manufacturing a pressing tool, comprising:

i) shaping a blank, which is able to be hardened, at least in part, to a final size of a pressing jaw, the pressing jaw including at least one contact face having at least one contact surface configured to be brought into operative contact with a running or sliding element; and ii) applying a laser beam to at least one selected region of a surface of the pressing jaw so as to form at least one hardened surface layer, the at least one selected region being positioned on the at least one contact surface, wherein the at least one selected region is positioned at a distance from at least one edge on the at least one contact surface such that the at least one selected region does not include the at least one edge on the at least one contact surface and such that the at least one edge on the at least one contact surface remains unhardened or at least largely unhardened.

10. The method according to claim 9, wherein at least one strip is beamed onto the at least one contact surface, the at least one strip extending with a constant width or with a varying width in a direction of longitudinal extension of the at least one strip.

11. The method according to claim 10, wherein the at least one strip is positioned at a predetermined distance from at least one edge and extends in a direction of running or sliding movement of the running or sliding element.

12. The method according to claim 11, wherein the at least one edge is an outer edge of the contact face.

13. The method according to claim 10, wherein the at least one strip is at least two or more strips, the strips being beamed by continuous feed.

14. The method according to claim 13, wherein the strips extend in a direction of running or sliding movement of the running or sliding element at a distance from one another.

15. The method according to claim 13, wherein, in a direction of longitudinal extension of the strips, the strips extend away from one another in a V-shape in a direction of running or sliding movement of the running or sliding elements.

16. The method according to claim 9, wherein the pressing jaw has a die and end faces adjacent to the die, each of the end faces being configured to form a sealing joint, and wherein a plurality of selected regions positioned in a transition from the die to the one of the end faces or on the contact surface are lased.

* * * * *